US008340558B2

(12) United States Patent
Mori

(10) Patent No.: US 8,340,558 B2
(45) Date of Patent: Dec. 25, 2012

(54) IMAGE-FORMING APPARATUS

(75) Inventor: Tomohide Mori, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 260 days.

(21) Appl. No.: 12/705,695

(22) Filed: Feb. 15, 2010

(65) Prior Publication Data

US 2010/0209150 A1 Aug. 19, 2010

(30) Foreign Application Priority Data

Feb. 16, 2009 (JP) ..... 2009-032744

(51) Int. Cl.
*G03G 15/01* (2006.01)

(52) U.S. Cl. ..... 399/302

(58) Field of Classification Search ..... 399/302, 399/308

See application file for complete search history.

(56) References Cited

U.S. PATENT DOCUMENTS

2005/0100369 A1 5/2005 Park et al.
2008/0310877 A1 12/2008 Hiroi et al.

FOREIGN PATENT DOCUMENTS

JP 2003-215947 A 7/2003
JP 2004-125900 4/2004
JP 2005-148732 6/2005
JP 2007-017666 A 1/2007
JP 2007-212921 A 8/2007
JP 2008-310199 12/2008

OTHER PUBLICATIONS

Translation of Mochizuki (JP 2007-212921 A, listed in IDS, pub date: Aug. 23, 2007).*
Translation of Mochizuki (JP 2007-017666 A, listed in IDS, pub date: Jan. 25, 2007).*
Translation of Bisaiji (DE 19835025 A1, pub date: Feb. 18, 1999).*
Office Action (Decision of Patent Grant) dated Dec. 21, 2010, issued in the corresponding Japanese Patent Application No. 2009-032744, and an English Translation thereof.

* cited by examiner

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

An image-forming apparatus is provided with: an intermediate transfer belt that has a hard layer formed on a surface thereof and supports a toner image that has been primarily transferred on the hard layer from a latent-image supporting member; and a secondary transfer roller that is pressed onto the intermediate transfer belt supporting the toner image with an image-recording medium being interposed therebetween, wherein a toner is supplied to a non-image area 17 in the contact area 16 of the surface of the intermediate transfer belt 3 with the image-recording medium at a rate of 0.01 to 0.20 g/m$^2$.

21 Claims, 5 Drawing Sheets

IMAGE-FORMING APPARATUS

This application is based on application No. 2009-32744 filed in Japan, the contents of which are hereby incorporated by reference.

BACKGROUND OF THE INVENTION

1. Field of the Invention

The present invention relates to an image-forming apparatus, such as a mono-chrome/full-color electrophotographic copying machine, a printer, a facsimile and a composite machine thereof.

2. Description of the Related Art

In a full-color image-forming apparatus using an intermediate transfer system, a plurality of toner images formed on a latent-image supporting member with respectively different colors are once transferred and superposed on an intermediate transfer belt, and then transferred onto an image-recording medium such as paper at one time so that a color image is obtained. The transferring process from the latent-image supporting member to the intermediate transfer belt is referred to as "primary transfer", and the transferring process from the intermediate transfer belt to the image-recording medium is referred to as "secondary transfer". In particular, in the secondary transferring process, the secondary transfer roller is pressed onto the intermediate transfer belt with the toner image supported thereon, with an image-recording medium interposed therebetween, while a bias voltage is applied to the secondary transfer roller or the like to generate an electric field thereon. Thus, the toner image is secondarily transferred onto the image-recording medium.

In such a secondary transferring process, it has been proposed that in order to improve the image quality, one or more hard layers are formed on the surface of the intermediate transfer belt (JP-A No. 2007-212921 and JP-A No. 2007-17666).

However, in case of using the intermediate transfer belt with hard layers formed on the surface thereof, when a hard foreign matter is pressed onto the belt surface by the secondary transfer roller in the secondary transferring process, a crack occurs on the surface layer to cause a dent in the resin of a substrate. For this reason, problems, such as image defects and cleaning defects, tend to occur from the initial stage. Examples of the foreign matter mainly include those transferred from the outside by the image-recording medium or the like and filler particles contained in paper or the like.

In particular, in the case where endurance printing operations for a long time are carried out, many cracks occur on the surface of the intermediate transfer belt to cause an increase in the surface roughness of the surface of the intermediate transfer belt, with the result that image defects occur conspicuously. In the case where a conventional intermediate transfer belt made from only the resin substrate is used, since the belt surface is worn out, the surface is maintained smoothly even after the endurance printing operations. However, in the case of the intermediate transfer belt with the hard layer formed on the surface, since the surface is not effectively worn out, the surface roughness increases in a one-sided manner when endurance printing operations are carried out. As a result, the smoothness on the hard layer is lost, the transferring rate is lowered and lack in uniformity of density tends to occur conspicuously. Moreover, the toner particles are buried to cause conspicuous cleaning defects.

An object of the present invention is to provide an image-forming apparatus that makes it possible to suppress an increase in surface roughness of an intermediate transfer belt and consequently to suppress occurrence of image defects sufficiently for a long period of time, even when the intermediate transfer belt having a hard layer is used.

BRIEF SUMMARY OF THE INVENTION

The present invention relates to an image-forming apparatus provided with: an intermediate transfer belt that has a hard layer formed on a surface thereof and supports a toner image that has been primarily transferred on the hard layer from a latent-image supporting member; and a secondary transfer roller that is pressed onto the intermediate transfer belt supporting the toner image, with an image-recording medium being interposed therebetween; wherein toner is supplied to a non-image area in a contact area of the surface of the intermediate transfer belt with the image-recording medium at a rate of 0.01 to 0.20 g/m$^2$.

The present invention also relates to an image-forming process comprising:

forming a latent image consisting of an image area and a non-image area on a latent-image supporting member, forming a toner image consisting of an image area and a non-image area on a latent-image supporting member by developing the latent image with a toner, transferring the toner image on the latent-image supporting member to an intermediate transfer belt having a hard layer on a surface thereof, and transferring the toner image on the intermediate transfer belt to an image-recording medium by contacting the toner image with the image-recording medium, wherein a toner is supplied to a non-image area in a contact area of the surface of the intermediate transfer belt with the image-recording medium at a rate of 0.01 to 0.20 g/m$^2$.

DETAILED DESCRIPTION OF THE INVENTION

An image-forming apparatus in accordance with the present invention is provided with an intermediate transfer belt that supports a toner image primarily transferred thereon from a latent-image supporting member and a secondary transfer roller that is pressed onto the intermediate transfer belt supporting the toner image with an image-recording medium interposed therebetween. The following description will discuss the image-forming apparatus of the present invention by exemplifying a tandem-type full-color image-forming apparatus provided with a latent-image supporting member for each of developing units for respective colors that form a toner image on the latent-image supporting member; however, those having other structures may be used as long as they have an intermediate transfer belt and a secondary transfer roller, and, for example, a four-cycle-type full-color image-forming apparatus provided with developing units for respective colors for a single latent-image supporting member may be used.

Figure 1:
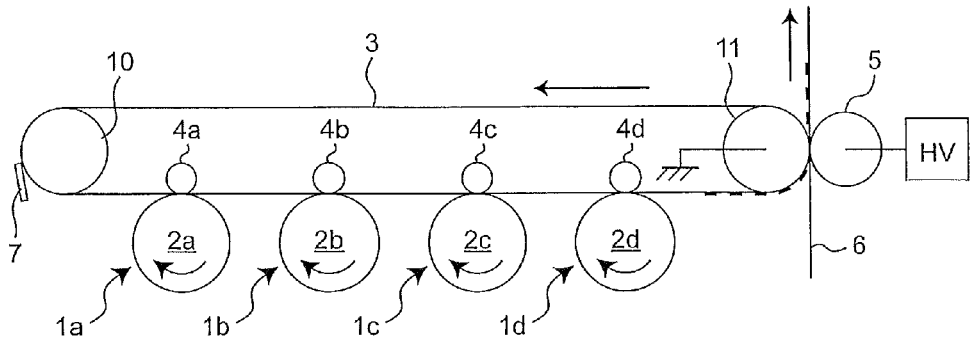
FIG. 1 is a schematic structural drawing that shows one example of an image-forming apparatus in accordance with the present invention.

FIG. 1 is a schematic structural drawing that shows one example of an image-forming apparatus of the present invention. In a tandem-type full-color image-forming apparatus shown in FIG. 1, each of developing units (1*a*, 1*b*, 1*c* and 1*d*) is normally provided with at least a charging device, an exposing device, a developing device, a cleaning device, and the like (none of which being shown) that are placed around each of latent-image supporting members (2*a*, 2*b*, 2*c* and 2*d*). These developing units (1*a*, 1*b*, 1*c* and 1*d*) are placed in parallel with an intermediate transfer belt 3 that is extended by at least two extension rollers (10 and 11) so as to be passed over them. Toner images formed on the surfaces of the latent-image supporting members (2*a*, 2*b*, 2*c* and 2*d*) in the respective developing units are respectively primary-transferred on the intermediate transfer belt 3 by using primary transfer rollers (4*a*, 4*b*, 4*c* and 4*d*), and superposed on the intermediate transfer belt so that a full-color image is formed. The full-color image transferred onto the surface of the intermediate transfer belt 3 is secondary-transferred onto an image-recording medium 6 such as paper at one time by using a secondary transfer roller 5, and then allowed to pass through a fixing device (not shown) so that a full-color image is formed on the image-recording medium. Here, residual toner after the transferring process, left on the intermediate transfer belt, is removed by a cleaning device 7. Hereinafter, an image that the user selects to be desirably printed and formed on an image-recording medium is referred to as "a selected image."

The latent-image supporting members (2*a*, 2*b*, 2*c* and 2*d*) are so-called photosensitive members on which toner images are formed based upon electrostatic latent images formed on the surfaces thereof. With respect to the latent-image supporting member, not particularly limited as long as it can be installed in a conventional image-forming apparatus of an electrophotographic system, such a member having an organic-based photosensitive layer is normally used.

The intermediate transfer belt 3 supports toner images formed on the latent-image supporting members in the respective developing units on its surface through primary-transferring processes. The primary-transferring processes are carried out by pressing the intermediate transfer belt 3 onto the latent-image supporting members (2*a*, 2*b*, 2*c* and 2*d*) supporting the toner images by the primary transfer rollers (4*a*, 4*b*, 4*c* and 4*d*), while an electric field is being generated by applying a bias voltage to the primary transfer rollers and the like, if necessary.

Figure 2:
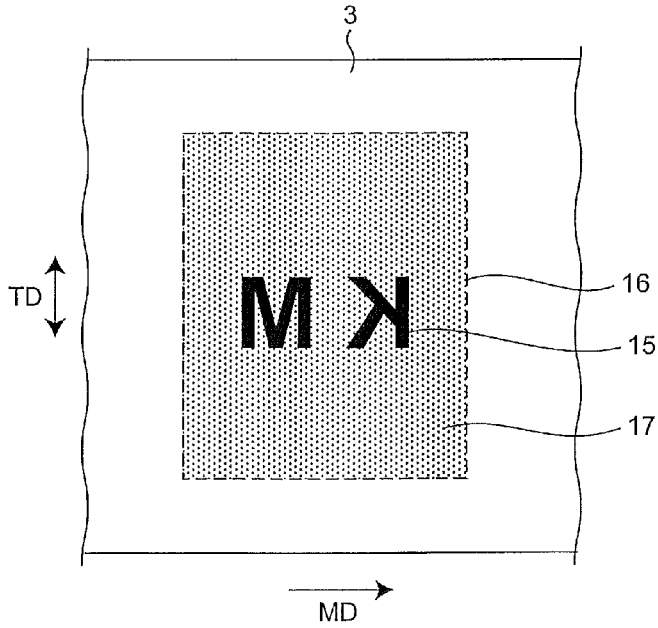
FIG. 2 is a schematic drawing that shows one example of a toner supplied state on the surface of an intermediate transfer belt immediately before a secondary transferring process in the image-forming apparatus of the present invention.

In the present invention, toner is supplied to a non-image area (image background portion) within a contact area of the surface of the intermediate transfer belt 3 with the image-recording medium. That is, upon forming a toner image 15 on the surface of the intermediate transfer belt 3 by the primary transferring process, for example, as shown in FIG. 2, so as to form the selected image on the image-recording medium, the toner is supplied to the non-image area 17 within the contact area 16 (area indicated by a broken line) of the surface of the intermediate transfer belt 3 with the image-recording medium. FIG. 2 is a schematic drawing that shows one example of a toner supplied state on the surface of the intermediate transfer belt immediately before a secondary transferring process, and in FIG. 2, TD indicates a width direction of the intermediate transfer belt 3, while MD indicates a moving direction of the intermediate transfer belt 3.

The contact area of the surface of the intermediate transfer belt 3 with the image-recording medium refers to the area 16 (area indicated by the broken line) on the surface of the intermediate transfer belt 3, which is made in contact with an image-recording medium 6 at the time of the secondary transferring process. Consequently, the size and the position of the contact area 16 are varied depending on the dimension and the transporting direction (paper passing direction) of the image-recording medium used for forming the selected image thereon.

The non-image area refers to an area other than the area on which the toner image is formed upon forming the selected image, and no toner is put on this area in the conventional system.

Figure 4:
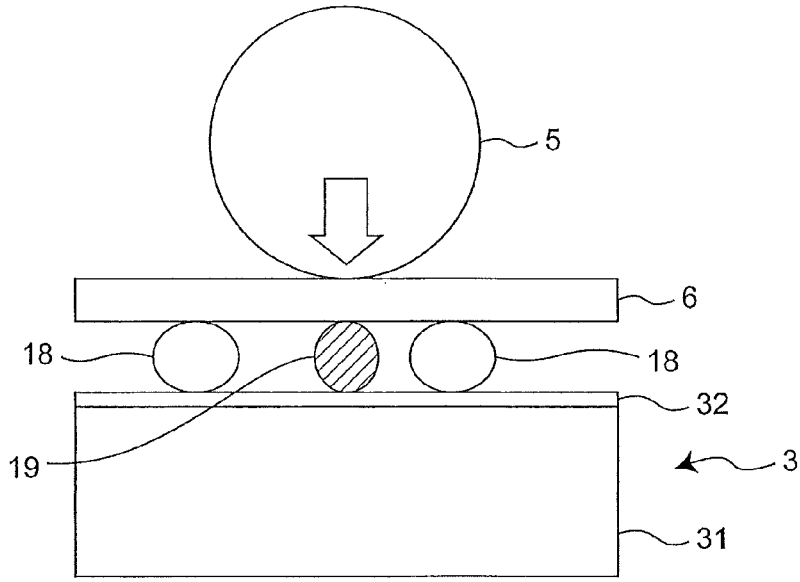
FIG. 4 is a schematic drawing of a secondary transferring unit, which shows a mechanism for suppressing cracks on a hard layer on the surface of the intermediate transfer belt at the time of the secondary transferring process in the image-forming apparatus of the present invention.

By supplying toner to such a non-image area 17 within the contact area 16 (area indicated by broken line) on the surface of the intermediate transfer belt 3, toner 18, thus supplied, functions as a spacer between the intermediate transfer belt 3 and the image-recording medium 6 at the time of the secondary transferring process, as shown in FIG. 4. As a result, it becomes possible to suppress the pressure from concentrating on a hard foreign matter 19, and consequently to suppress a crack from occurring on a hard layer 32 on the surface of the intermediate transfer belt; thus, it is possible to suppress the surface roughness of the intermediate transfer belt surface from increasing. Hereinafter, the toner 18 to be supplied to the non-image area 17 on the surface of the intermediate transfer belt is referred to as "spacer toner". FIG. 4 is a schematic drawing of a secondary transfer unit, which shows a mechanism by which the image-forming apparatus in accordance with the present invention suppresses cracks from occurring in the hard layer on the surface of the intermediate transfer belt at the time of the secondary transferring process.

Figure 5:
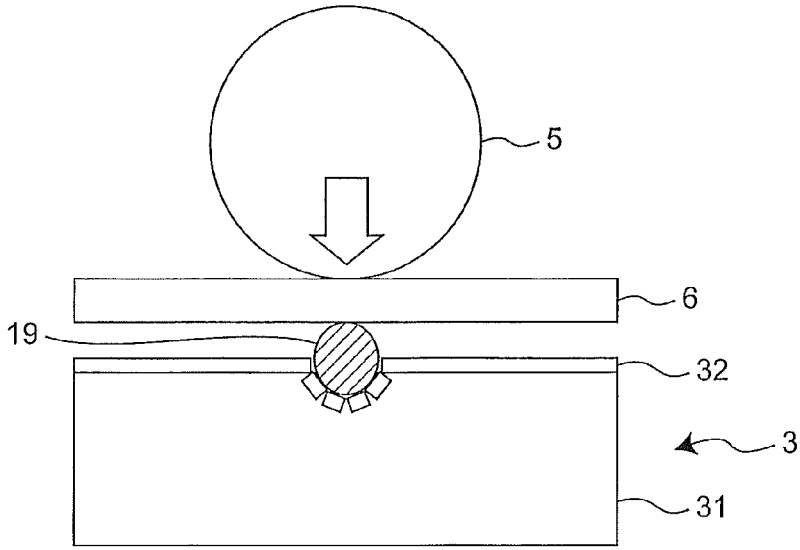
FIG. 5 is a schematic drawing of a secondary transferring unit, which shows a mechanism in which cracks occur on the hard layer on the surface of the intermediate transfer belt at the time of a secondary transferring process in a conventional image-forming apparatus.

When no spacer toner 18 is supplied to the non-image area 17 within the contact area 16 of the surface of the intermediate transfer belt 3 with the image-recording medium 6, cracks occur in the hard layer on the intermediate transfer belt to cause an increased surface roughness at the time of endurance printing, resulting in image defects. Such a phenomenon is considered to be caused based upon the following mechanism. In order to ensure smoothness and non-permeability of the surface, inorganic particles made from calcium carbonate or the like are added as filler in PPC paper to be generally used as an image-recording medium. Since the image-recording medium is transported by a plurality of rollers by reaching the secondary transferring process, the filler is isolated onto the surface due to stress during the transporting process. When the hard foreign matter 19 derived from the filler or the like is pressed onto the surface of the intermediate transfer belt 3 by the secondary transfer roller 5, as shown in FIG. 5, during the secondary transferring process, a dent is formed on the surface of the belt to cause a crack on the hard layer 32 of the belt surface. Consequently, the surface roughness of the belt increases. When the number of cracks on the hard layer 32 increases, the surface smoothness of the hard layer deteriorates to cause degradation of the transferring property, and since toner enters the cracks, cleaning defects tend to occur. FIG. 5 is a schematic drawing of the secondary transfer unit, which shows a mechanism in which cracks occur in the hard layer of the surface of the intermediate transfer belt at the time of the secondary transferring process in a conventional image-forming apparatus.

Figure 3:
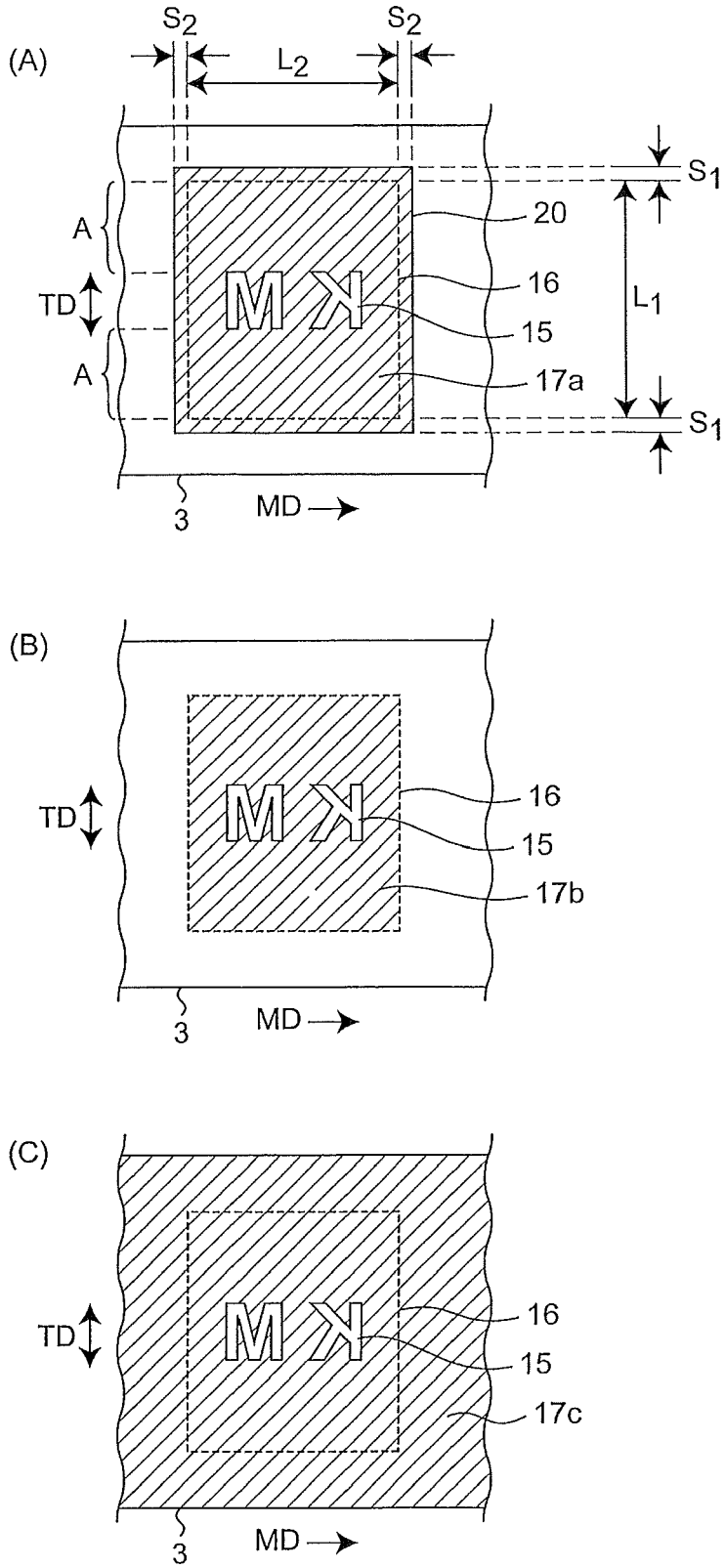
FIGS. 3 (A) to 3 (C) are schematic drawings that show preferable specific examples of supply areas of spacer toner.

The supply area of the spacer toner 18 on the surface of the intermediate transfer belt 3 includes at least the non-image area 17 within the contact area 16 of the surface of the intermediate transfer belt 3 with the image-recording medium. Therefore, the supply area of the spacer toner is changed depending on the shape and dimension of a selected image. More specifically, although not particularly limited as long as it includes the non-image area 17 within the contact area 16 of the surface of the intermediate transfer belt 3 with the image-recording medium, the supply area of the spacer toner is preferably designed so as not to include the toner image area 15 of the selected image, from the viewpoint of further improving the color reproducibility and contrast of a printed image. This arrangement is made because the color tone of the selected image is varied due to the spacer toner. Specific examples of such a preferred supply area of the spacer toner 18 include areas 17*a*, 17*b* and 17*c* indicated by slanted-line areas in FIGS. 3(A) to 3(C). In FIG. 3 (A), the spacer toner is supplied to the non-image area 17*a* (slanted-line area) within an area including the contact area 16 of the surface of the intermediate transfer belt 3 with the image-recording medium and an area 20 that is wider than the contact area 16. In FIG. 3 (B), the spacer toner is supplied to the non-image area 17*b* (slanted-line area) within the contact area 16 of the surface of the intermediate transfer belt 3 with the image-recording medium. FIG. 3 (B) shows an arrangement in which the supply area 17 of the spacer toner shown in FIG. 2 is extracted as "17*b*". In FIG. 3 (C), the spacer toner is supplied to the non-image area 17*c* (slanted-line area) on the entire surface of the intermediate transfer belt 3. From the viewpoint of preventing back contamination of paper, preferably, the spacer toner is supplied to the non-image area 17*a* (slanted-line area) shown in FIG. 3 (A) or the non-image area 17*b* (slanted-line area) shown in FIG. 3 (B). From the viewpoints of preventing irregularities of paper passing and of toner economical efficiency, preferably, the spacer toner is supplied to the non-image area 17*a* (slanted-line area) shown in FIG. 3 (A).

In this case, "the area 20 that is wider than the contact area 16 of the surface of the intermediate transfer belt 3 with the image-recording medium", shown in FIG. 3 (A), corresponds to an area obtained when, supposing that, in the contact area 16 of the surface of the intermediate transfer belt 3 with the image-recording medium, the length in a TD direction is $L_1$, and that the length in a MD direction is $L_2$, the two ends in the TD direction are respectively extended by a length $S_1$ corresponding to $L_1/100$ to $L_1/10$, in particular, to $L_1/100$ to $L_1/50$, independently, while the two ends in the MD direction are respectively extended by a length $S_2$ corresponding to $L_2/100$ to $L_2/10$, in particular, to $L_2/100$ to $L_2/50$, independently. In other words, "the area 20 that is wider than the contact area 16" means the outside area of the contact area 16, that is obtained by removing the contact area 16 from the non-image area 17*a*.

The spacer toner 18 is supplied at a rate in a range from 0.01 to 0.20 g/m$^2$, more preferably, from 0.01 to 0.20 g/m$^2$. The supply amount is defined as a value on the intermediate transfer belt. When the supply amount of the spacer toner is too small, the effect for preventing an increase in the surface roughness is not obtained sufficiently. When the supply amount of the spacer toner is too large, an image caused by the spacer toner appears conspicuously on the background portion of the selected image that has been printed on the image-recording medium, and this is recognized as a stain or fogging.

The toner image that the spacer toner 18 forms on the surface of the intermediate transfer belt is not particularly limited, as long as it is formed virtually evenly on the entire supply area in the above-mentioned amount of supply, and, for example, it may be formed in a dot image mode as shown in FIG. 2, or may be formed in an entire exposed image mode. From the viewpoint of color reproducibility, the spacer toner preferably forms a toner image having the dot image mode in the above-mentioned amount of supply.

When the spacer toner image has the dot image mode, the size, intervals and layout of the dots are not particularly limited, as long as the object of the present invention is achieved. The size of the dots is normally set in a range from 30 to 100 μm, more preferably, from 30 to 60 μm. The dot intervals are normally set in a range from 0.1 to 3.0 mm, more preferably, to 1.0 to 3.0 mm. In FIG. 2, the dots are placed in a lattice pattern; however, not particularly limited thereto, as long as the above-mentioned amount of supply is ensured, they may be placed at random.

Since the spacer toner 18 is supplied in the above-mentioned amount of supply, hardly any influences are given to the selected image. Moreover, the same toner as that used for forming the selected image is used as the spacer toner 18, and supplied by the primary transferring process. For this reason, the spacer toner may be supplied from any one of the developing units. The supply of the spacer toner 18 may be executed by one or more developing units, for example, selected from the group of the developing units 1*a*, 1*b*, 1*c* and 1*d* shown in FIG. 1. From the viewpoint of reducing influences of the spacer toner to the selected image to a minimum level, the spacer toner 18 is preferably a yellow toner supplied solely by the yellow developing unit. When the spacer toner is supplied by two or more developing units, the total of the amounts of supply may be preferably set in the above-mentioned range.

The supply of the spacer toner 18 from the developing unit is carried out by controlling an exposing device disposed on the periphery of the latent-image supporting member and an exposure control device that is coupled to the exposing device. More specifically, for example, a selected image to be printed by a predetermined developing unit is first recognized by the exposing device or an image-processing apparatus. Next, a signal is sent from the exposure control device to the exposing device so as to supply the spacer toner to a predetermined supply area on the intermediate transfer belt in a predetermined amount of supply in a predetermined image mode, based upon the information of the selected image to be printed, the rotation speed of the latent-image supporting member, the moving speed of the intermediate transfer belt and the size and the transporting speed of an image-recording medium, and the like. Next, the surface of the latent-image supporting member is exposed by the exposing device based upon the signal so that a latent image is formed, and this is then subjected to a developing process and a primary transferring process in the same method as a conventional method. As a result, the supply of the spacer toner is achieved. During these processes, in the developing unit, exposing, developing and primary transferring processes are also simultaneously carried out on the toner image area of the selected image to be printed. Thereafter, secondary transferring and fixing processes are carried out by using the same method as that of the conventional method.

The intermediate transfer belt 3 has a hard layer on the outer circumferential surface thereof. FIG. 4 shows the intermediate transfer belt 3 having a structure in which a hard layer 32 is formed on a substrate 31; however, not limited thereto, as long as the intermediate transfer belt has the hard layer 32 on the surface thereof, for example, a structure having another layer between the substrate and the hard layer may be used.

Although not particularly limited, the substrate 31 preferably has a surface resistivity in a range from $10^6$ to $10^{12}$ Ω/□., and is normally formed into a seamless belt. Examples of materials forming the substrate include: polycarbonate (PC); polyimide (PI); polyphenylene sulfide (PPS); polyamideimide (PAI); fluorine-based resins such as polyvinylidene fluoride (PVDF) and tetrafluoroethylene-ethylene copolymer (ETFE); urethane-based resins such as polyurethane; resin materials, such as polyamide-based resins such as polyamideimide, or rubber materials such as ethylene-propylene-diene rubber (EPDM); nitrile-butadiene rubber (NBR); chloroprene rubber (CR); silicone rubber; and urethane rubber, and a mixture thereof. The substrate may contain conductive filler. Examples of the conductive filler include carbon, zinc antimonite, tin oxide, zinc oxide, potassium titanate, indium oxide and a metal oxide of these composite oxides and the like, or an ionic conductive material or the like. The thickness of the substrate is normally set to about 50 to 200 μm in the case of a resin material, and to about 300 to 700 μm in the case of a rubber material.

Prior to the lamination of the hard layer 32, the substrate 31 may be subjected to a pretreatment by using a known surface treatment, such as irradiation with plasma, flame, ultraviolet rays or the like.

The hard layer 32 may be prepared either as an inorganic layer made from an inorganic material or as an organic layer made from an organic material. Although not particularly limited, the thickness of the hard layer is preferably set to 10 nm to 1 μm, more preferably to 10 to 500 nm, from the viewpoint of preventing cracks and separations of the layer due to bending.

The hardness of the hard layer 32 is normally set to 3 GPa or more, in particular, to 3 to 11 GPa.

In the present specification, the hardness is measured by a nano-indentation method, and the hardness value measured by using a NANO Indenter XP/DCM (MTS System Co., Ltd./MTS NANO Instruments Co., Ltd.).

The surface roughness Ra of the hard layer 32 is normally set to 10 to 100 nm, in particular, to 20 to 50 nm.

The surface roughness Ra is indicated by an average value of measured values of arbitrary three points measured by a non-contact three-dimensional shape measuring device (WYKO NT1100 made by Veeco Instruments, Inc.).

Specific examples of the hard layer include an inorganic oxide layer, a hard carbon-containing layer and a hard resin layer.

The inorganic oxide layer is preferably made from a material containing at least one oxide selected from the group consisting of silicon oxide, aluminum oxide, zirconium oxide, titanium oxide and zinc oxide, and in particular, silicon oxide ($SiO_2$) is preferably used. The inorganic oxide layer is preferably formed by using a plasma CVD method in which a mixed gas of at least a discharge gas and a material gas for the inorganic oxide layer is formed into plasma so as to deposit and form a film corresponding to the material gas, in particular, by using such a plasma CVD method carried out under the atmospheric pressure or under a pressure near the atmospheric pressure. Although not particularly limited, the thickness of the inorganic oxide layer is preferably set to, for example, 10 to 500 nm.

The following description will exemplify a formation of the inorganic oxide layer containing silicon oxide ($SiO_2$) by using the atmospheric-pressure CVD method, and explain its manufacturing device and manufacturing method. The atmospheric pressure or pressure near the atmospheric pressure corresponds to about 20 kPa to 110 kPa, and in order to obtain desired effects described in the present invention, the pressure is preferably set to 93 kPa to 104 kPa.

Figure 6:
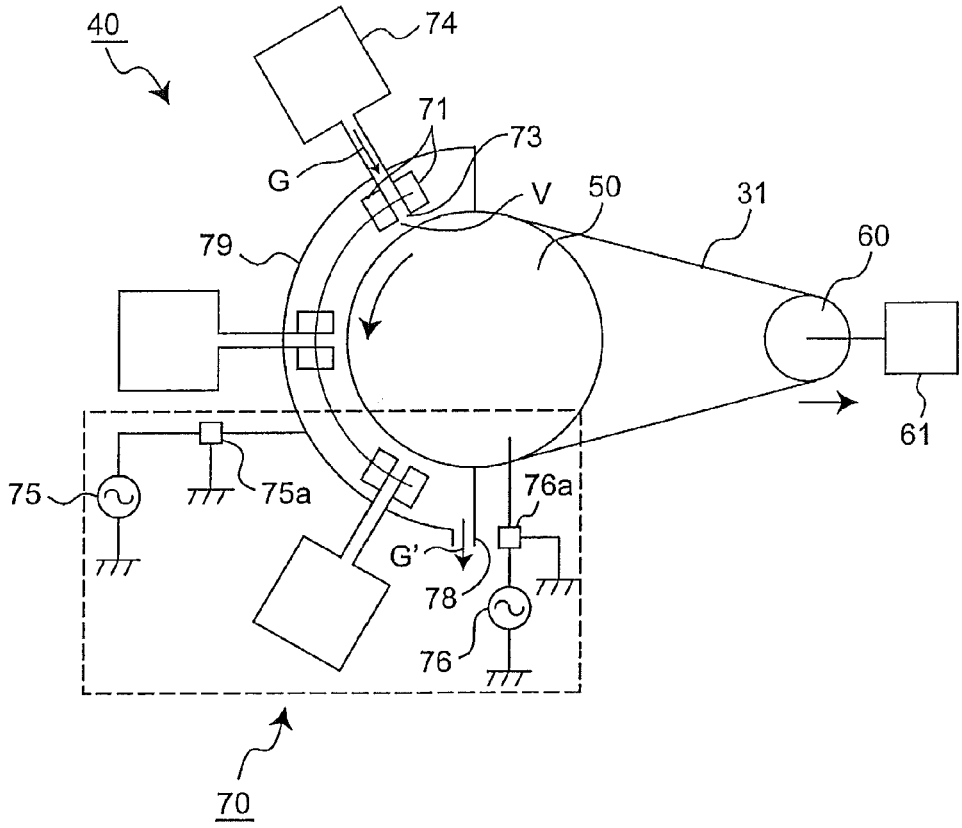
FIG. 6 is an explanatory drawing that shows a manufacturing device that manufactures an intermediate transfer belt.

FIG. 6 is an explanatory drawing that shows a manufacturing device for manufacturing the inorganic oxide layer. A manufacturing device 40 of the inorganic oxide layer is designed to form an inorganic oxide layer on a substrate by using a direct system in which the substrate is exposed to plasma, with the discharge space and the thin-film depositing area being set to virtually the same portion, so as to carry out depositing and forming processes on the substrate, and is configured by a roll electrode 50 and a driven roller 60 that rotate in an arrow direction, with an endless belt-shaped substrate 31 being passed thereon, and an atmospheric-pressure plasma CVD device 70 serving as a film-forming device used for forming the inorganic oxide layer on the surface of the substrate.

The atmospheric-pressure plasma CVD device 70 is provided with at least one set of fixed electrodes 71 disposed on the periphery of the roll electrode 50, a discharge space 73 forming an opposing area between the fixed electrodes 71 and the roll electrode 50 in which a discharge is executed, a mixed-gas supply device 74 that generates a mixed gas G including at least a material gas and a discharge gas, and supplies the mixed gas G to the discharge space 73, a discharge container 79 that suppresses air from flowing into the discharge space 73 or the like, a first power supply 75 connected to the fixed electrodes 71, a second power supply 76 connected to the roll electrode 50, and an exhaust unit 78 that discharges an used exhaust gas G'. The second power supply 76 may be connected to the fixed electrode 71, and the first power supply 75 may be connected to the roll electrode 50.

The mixed-gas supply device 74 supplies a mixed gas of a material gas used for forming a film containing silicon oxide and a rare gas such as a nitrogen gas or an argon gas, to the discharge space 73.

The driven roller 60 is pressed in an arrow direction by a tension applying means 61 so that a predetermined tension is given to the substrate 31. The tension applying means 61 is designed to release the applied tension upon exchanging the substrate 31 or the like so as to easily exchange the substrate 31 or the like.

The first power supply 75 outputs a voltage with a frequency of ω1 and the second power supply 76 outputs a voltage with a frequency of ω2 that is higher than the frequency of ω1 so that an electric field V in which the frequencies of ω1 and ω2 are multiplexed is generated in the discharge space 73 by these voltages. Thus, the mixed gas G is formed into plasma by the electric field V so that a film (inorganic oxide layer) derived from the material gas contained in the mixed gas G is deposited on the surface of the substrate 31.

Another mode may be proposed in which one of the electrodes of the roll electrode 50 and the fixed electrodes 71 is earthed, while the other electrode is connected to a power supply. In this case, the second power supply is preferably used as the power supply because a solid film formation is precisely carried out, and, in particular, this mode is preferably used when a rare gas such as argon gas is used as the discharge gas.

Among a plurality of fixed electrodes, by using those fixed electrodes located on the downstream side in the rotation direction of the roll electrode and the mixed gas supply device, inorganic oxide layers may be deposited in a manner so as to be laminated so that the thickness of the inorganic oxide layer is adjusted.

Among a plurality of fixed electrodes, by using the fixed electrode located on the farthest downstream side in the rotation direction of the roll electrode and the mixed gas supply device, inorganic oxide layers may be deposited, while by using the other fixed electrodes located on the upper stream side and the mixed gas supply device, another layer, for example, such as an adhesion layer for improving the adhesive property between the inorganic oxide layer and the substrate, may be formed.

In order to improve the adhesive property between the inorganic oxide layer and the substrate, a gas supply device for supplying a gas, such as argon, oxygen or hydrogen, and a fixed electrode may be arranged on the upstream side of the fixed electrode and the mixed gas supply device used for forming inorganic oxide layers so that a plasma process is carried out so as to activate the surface of the substrate.

Specific examples of the hard carbon-containing layer include an amorphous carbon film, a hydrogenated amorphous carbon film, a tetrahedron amorphous carbon film, a nitrogen-containing amorphous carbon film and a metal-containing amorphous carbon film. The thickness of the hard carbon-containing layer is preferably set to the same thickness as that of the inorganic oxide layer.

The hard carbon-containing layer can be formed by using the same method as that of the producing method of the inorganic oxide layer; that is, it can be formed by using a plasma CVD method in which a mixed gas of at least a discharge gas and a material gas is formed into plasma so as to deposit and form a film corresponding to the material gas, in particular, by using such a plasma CVD method carried out under the atmospheric pressure or under a pressure near the atmospheric pressure.

As the material gas used for forming the hard carbon-containing layer, an organic compound gas that assumes a gas or a liquid at normal temperature, such as, in particular, hydrogen carbide gas, is preferably used. The phase state of this material is not necessarily required to have a gaseous phase at normal temperature and normal pressure, and any liquid-phase or solid-state material may be used as long as it is evaporated by fusion, evaporation, sublimation or the like through a heating or pressure-reducing process in the mixed gas supply device. Examples of the hydrogen carbide gas serving as a material gas include: gases containing at least hydrogen carbides, such as paraffin-based hydrogen carbide such as $CH_4$, $C_2H_6$, $C_3H_8$ and $C_4H_{10}$, acetylene-based hydrogen carbide such as $C_2H_2$ and $C_2H_4$, olefin-based hydrogen carbide, di-olefin-based hydrogen carbide, and aromatic hydrogen carbide. Moreover, in addition to hydrogen carbides, any compounds may be used as long as they contain at least carbon elements, such as alcohols, ketones, ethers, esters, CO or $CO_2$.

The cured resin layer is a resin layer that is formed by coating a curable resin formed by dispersing a conductive filler therein and curing it by applying heat or light (UV). The same conductive filler as that to be contained in the substrate may be used as the conductive filler. As the curable resin, any known resins in the field of resins that have a curing property may be used, and examples thereof include acryl-based UV curable resins, polycarbonate-based UV curable resins and the like.

The curable resin is available as a commercial product.

Examples of the acryl-based UV curable resin include Sanrad (made by Sanyo Chemical Industries Ltd.) and the like.

Examples of the polycarbonate-based UV curable resin include Eupiron (made by Mitsubishi Gas Chemical Co., Inc.) and the like.

The primary transfer roller 4 (4*a*, 4*b*, 4*c*, 4*d*) is disposed on the side reversed to the latent-image supporting member 2 relative to the intermediate transfer belt 3. By pressing the intermediate transfer belt 3 using the primary transfer roller 4 (4*a*, 4*b*, 4*c*, 4*d*), with a bias voltage being applied to the primary transfer roller 4 on demand, a toner image, supported on the surface of the latent-image supporting member 2 (2*a*, 2*b*, 2*c*, 2*d*), is primarily transferred onto the intermediate transfer belt 3.

Upon applying a bias voltage onto the primary transfer roller, for example, a DC component that has a reverse polarity to the toner charging polarity, with its absolute value being set in a range from 300 to 3000V, in particular, from 600 to 1500V, is used. The reverse polarity to the toner charging polarity refers to the +polarity, for example, in the case of the negatively chargeable toner, and also to the −polarity in the case of the positively chargeable toner. Together with the DC component, an AC component may be multiplexed onto the primary transfer roller.

Although not particularly limited, for example, the primary transfer roller may have a structure in which a core metal has, on the surface thereof, a coat layer formed by dispersing carbon or the like as a conductive material in EPDM, NBR or the like, or may be prepared as a metal roller or the like.

The secondary transfer roller 5 is disposed on the side reversed to the extension roller 11 relative to the intermediate transfer belt 3. By pressing the intermediate transfer belt 3 supporting the toner image using the secondary transfer roller 5 with an image-recording medium 6 being interposed therebetween, the toner image is secondarily transferred on the image-recording medium 6. A bias voltage is applied to the secondary transfer roller on demand so that the secondary transferring process can be accelerated.

Although not particularly limited, the secondary transfer roller preferably has a structure with an elastic layer. This structure is used so as to ensure an adhesive property to the image-recording medium.

As the structure of the secondary transfer roller with an elastic layer, for example, a structure having an elastic layer on the surface of a core metal is proposed. Metal such as iron and stainless may be used as the core metal.

The elastic layer is a layer having Asker C hardness in a range from 20° to 60°, preferably, from 30° to 50°.

In the present specification, the Asker C hardness is indicated by a value measured by Asker rubber hardness tester C-type.

The elastic layer is formed by using an elastic material, such as ethylene-propylene-diene rubber (EPDM); nitrile-butadiene rubber (NBR); chloroprene rubber (CR); silicone rubber; and urethane rubber, and a conductive material is normally contained therein. For example, carbon or the like may be used as the conductive material.

The thickness of the elastic layer is normally set to 1 to 20 mm, preferably, to 3 to 10 mm.

From the viewpoint of ensuring the transferring property, the resistivity of the secondary transfer roller is preferably set to $10^5$ to $10^{10}\Omega$, preferably, to $10^6$ to $10^8\Omega$.

When a bias voltage is applied to the secondary transfer roller, for example, a DC component that has a reverse polarity to the toner charging polarity, with its absolute value being set in a range from 300 to 5000V, in particular, from 600 to 3000V, is used. Together with the DC component, an AC component may be multiplexed onto the secondary transfer roller.

Although not particularly limited, for example, metal rollers made from aluminum, iron or the like, may be used as the extension rollers (10 and 11). Moreover, the extension rollers may have a structure in which a core metal has, on the peripheral surface thereof, a coat layer formed by dispersing conductive powder or carbon into an elastic material such as EPDM, NBR, urethane rubber and silicone rubber, with its resistance value being adjusted to $1\times10^9\Omega\cdot$cm or less.

With respect to the other members and devices installed in the image-forming apparatus of the present invention, that is, for example, a cleaning device 7, a charging device, an exposing device, a developing device and a cleaning device for the latent-image supporting member, not particularly limited, those known members and devices conventionally used in the image-forming apparatus may be used.

For example, with respect to the developing device, those having a mono-component developing system using only toner, or those having a two-component developing system using toner and carrier, may be used.

The toner may contain toner particles manufactured by a wet method, such as a polymerization method, or toner particles manufactured by a pulverizing method (dry method).

Not particularly limited, the average particle size of the toner is preferably set to 7 μm or less, more preferably, in a range from 4.5 μm to 6.5 μm.

Not particularly limited, the toner chargeability may be set to positive chargeability or negative chargeability.

EXAMPLES

Experimental Example A

Production of Intermediate Transfer Belt

A seamless substrate, made by dispersing carbon in a PPS resin with a surface resistivity of $1.30\times10^9$ Ω/□ and a thickness of 120 μm, was obtained through an extrusion molding process.

A thin layer, made from $SiO_2$ having a film thickness of 200 nm, a hardness of 4 GPa and a surface roughness Ra of 31 nm, was formed on the outer circumferential surface of the substrate by using a device as shown in FIG. 6 based upon an atmospheric-pressure plasma CVD method so that an intermediate transfer belt was obtained.

<Production of Secondary Transfer Roller>

An elastic layer, obtained by dispersing carbon serving as a conductive material into NBR, was formed with a thickness of 8.5 mm on the outer circumferential surface of a core metal member made of iron with a diameter of 8 mm so that a secondary transfer roller was obtained. The Asker C hardness thereof was 42°, and the resistivity thereof was $10^6\Omega$.

Example 1

The intermediate transfer belt and the secondary transfer roller, produced in the above-mentioned methods, were installed in a printer (Bizhub C353; made by Konica Minolta Technologies, Inc.), and printing operations of 100,000 sheets were carried out on sheets of J paper ((A-4 size) made by Konica Minolta Technologies, Inc.) by using a character image "KM" as a selected image. The same conditions as the standard conditions of the above-mentioned printer were used except that the intermediate transfer belt and the secondary transfer roller were used and that spacer toner was supplied by using a method as described below. The average particle size of the toner was 6.5 μm.

(Spacer Toner Supply)

As shown in FIG. 3 (A), upon forming an image, yellow toner was supplied to a non-image area 17*a* within an area including a contact area 16 ($L_1$: 297 mm, $L_2$: 210 mm) of the surface of an intermediate transfer belt 3 with an image-recording medium and an area 20 that is wider than the contact area 16, at a rate of 0.05 g/m$^2$ as a spacer toner. The area 20, that is wider than the contact area 16, was wider in each of the two ends in the TD direction of FIG. 3 (A) by 4 mm ($S_1$), and was also wider in each of the two ends in the MD direction by 4 mm ($S_2$). A toner image derived from the spacer toner had a dot image mode, with each dot having a size of 30 μm, with dot intervals of 2 mm, and the dots were disposed in a lattice pattern. No spacer toner was supplied to a toner image area 15 inside the contact area 16.

(Evaluation)

After the printing operations of 100,000 sheets, on areas that were areas to be made in contact with the image-recording medium, without any character image being formed thereon, on the surface of the intermediate transfer belt (two belt-shaped areas A shown in FIG. 3 (A)), the surface roughness Ra was measured at an arbitrary measuring point. The Ra value was 81 nm. Moreover, the secondary transferring rate was not lowered from the initial value, and neither lack in uniformity of density nor cleaning defects were found on the printed images. At this time, although an image derived from the spacer toner slightly appeared on the background portion of the printed image on the surface of paper, this was such a slight degree that no problem was caused in practical use.

Figure 7:
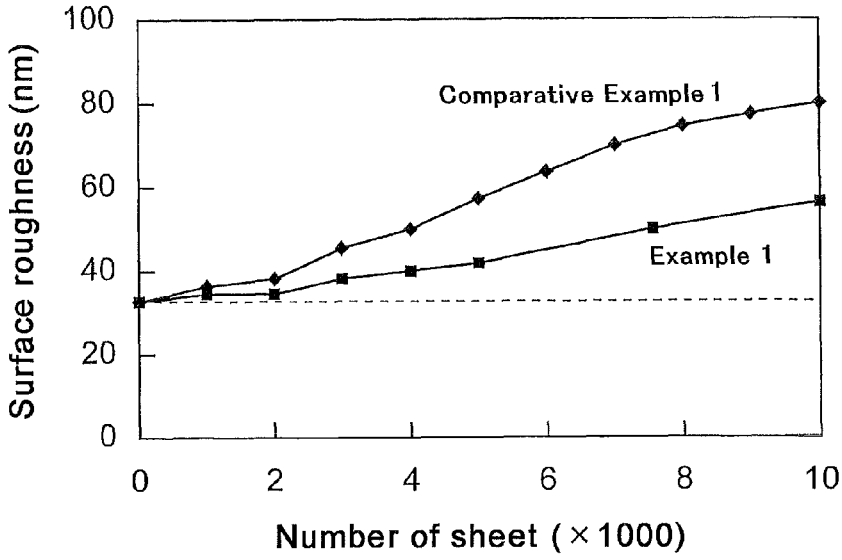
FIG. 7 is a graph that shows data obtained in example 1 and comparative example 1 in experimental example A.

The change in the surface roughness due to the printing operations was traced within a range to the number of printed sheets of 10,000. The Ra value after the printing operations of 10,000 sheets was 55 nm. FIG. 7 shows the results thereof.

Comparative Example 1

By using the same method as that of example 1 except that no spacer toner was supplied, endurance printing operations were carried out, and evaluation was made.

The Ra value was 120 nm. Moreover, the secondary transferring rate was lowered from the initial state, and lack in uniformity of density and cleaning defects were found on the printed images.

The change in the surface roughness due to the printing operations was traced within a range to the number of printed sheets of 10,000. The Ra value after the printing operations of 10,000 sheets was 80 nm. FIG. 7 shows the results thereof.

Example 2

By using the same method as that of example 1 except that the amounts of supply of the spacer toner were respectively set to 0.01 g/m$^2$, 0.10 g/m$^2$, 0.15 g/m$^2$ and 0.20 g/m$^2$, endurance printing operations were carried out, and evaluation was made.

The dot image derived from the spacer toner was the same as that of example 1, except that the dot sizes were changed in response to the predetermined amounts of supply of the spacer toner.

(Evaluation)

After the printing operations of 100,000, the Ra value was 87 nm when the amount of supply of the spacer toner was 0.01 g/m$^2$, 74 nm when the amount of supply was 0.10 g/m$^2$, 70 nm when the amount of supply was 0.15 g/m$^2$, and 68 nm when the amount of supply was 0.20 g/cm$^2$.

The following result of evaluation was commonly obtained in any of the amounts of toner supply.

The secondary transferring rate was not lowered from the initial value, and neither lack in uniformity of density nor cleaning defects were found on the printed images. At this time, although an image derived from the spacer toner slightly appeared on the background portion of the printed image on the surface of paper, this was such a slight degree that no problem was caused in practical use.

Experimental Example B

By using the same method as that of example 1 except that the amounts of supply of the spacer toner were respectively set to 0 g/m$^2$, 0.01 g/m$^2$, 0.05 g/m$^2$, 0.40 g/m$^2$ and 0.60 g/m$^2$ and that the number of printed sheets was set to 10,000, endurance printing operations were carried out, and evaluation was made.

The dot image derived from the spacer toner was the same as that of example 1, except that the dot sizes were changed in response to the predetermined amounts of supply of the spacer toner.

Figure 8:
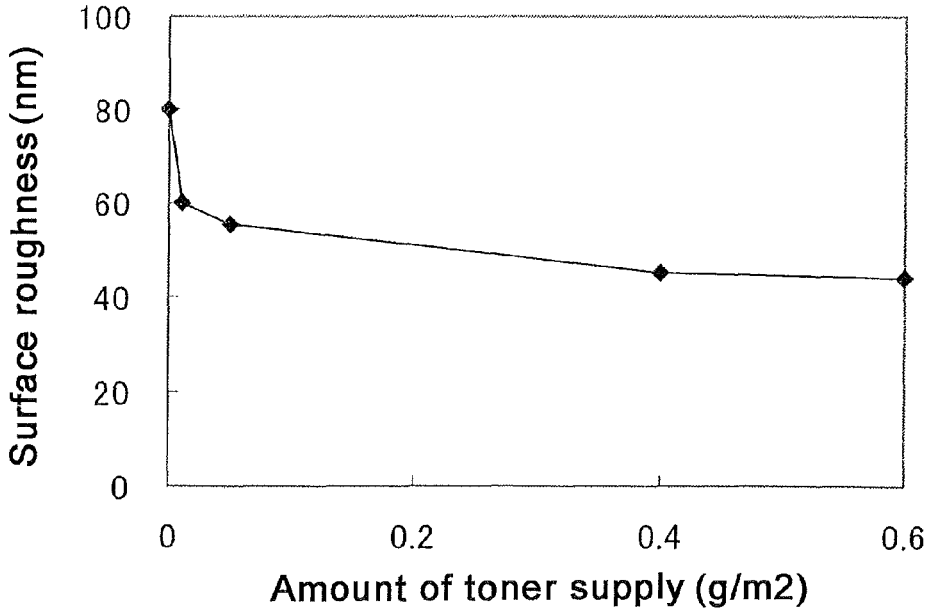
FIG. 8 is a graph that shows data obtained in experimental example B.

FIG. 8 shows a relationship between the surface roughness and the amount of toner supply after the endurance printing operations.

As shown in FIG. 8, in the case of the amount of toner supply of 0.01 g/m$^2$ or more, the surface roughness was greatly lowered, and up to 0.40 g/m$^2$, there was the tendency that as the amount of toner supply increases, the surface roughness is lowered. In particular, in the cases of the amounts of toner supply of 0.01 g/m$^2$ and 0.05 g/m$^2$, the secondary transferring rate was not lowered from the initial value, and neither lack in uniformity of density nor cleaning defects were found on the printed images. At this time, although an image derived from the spacer toner slightly appeared on the background portion of the printed image on the surface of paper, this was such a slight degree that no problem was caused in practical use.

In contrast, in the cases of the amounts of toner supply of 0.40 g/m$^2$ and 0.60 g/m$^2$, an image derived from the spacer toner appeared conspicuously on the background portion of the printed image on the surface of paper, and this was recognized as a stain or fogging.

Effects of the Invention

In accordance with the present invention, even when an intermediate transfer belt having a hard layer is used, it becomes possible suppress an increase in surface roughness of the intermediate transfer belt for a long time. As a result, it is possible to sufficiently suppress image defects from occurring. In the present invention, the area to which toner is supplied so as to suppress the increase in surface roughness is a non-image area in the contact area of the surface of the intermediate transfer belt with the image-recording medium, and since the amount of toner supply is very small, the color reproducibility and contrast of a printed image hardly deteriorate.

The generation of noise that is recognized as a stain, fogging and the like on the background portion of a printed image on the image-recording medium can be suppressed sufficiently.

What is claimed is:

1. An image-forming apparatus comprising:

an intermediate transfer belt that has a hard layer formed on a surface thereof and supports a toner image that has been primarily transferred on the hard layer from a latent-image supporting member; and a secondary transfer roller that is pressed onto the intermediate transfer belt supporting the toner image, with an image-recording medium being interposed therebetween, wherein a toner is supplied to a non-image area in a contact area of the surface of the intermediate transfer belt with the image-recording medium at a range of 0.01 to 0.20 g/m$^2$.

2. The image-forming apparatus of claim 1, wherein the secondary transfer roller has an elastic layer.

3. The image-forming apparatus of claim 1, wherein the hard layer of the intermediate transfer belt is a layer selected from the group consisting of an inorganic oxide layer, a hard carbon-containing layer and a cured resin layer.

4. The image-forming apparatus of claim 1, wherein the hard layer of the intermediate transfer belt is an inorganic oxide layer containing at least one oxide selected from the group consisting of silicon oxide, aluminum oxide, zirconium oxide, titanium oxide and zinc oxide.

5. The image-forming apparatus of claim 1, wherein the toner is supplied to an non-image area within the contact area of the surface of the intermediate transfer belt with the image-recording medium.

6. The image-forming apparatus of claim 1, wherein the toner is supplied to a non-image area within an area including the contact area of the surface of the intermediate transfer belt with the image-recording medium and an area that is wider than the contact area.

7. The image-forming apparatus of claim 6, wherein the area that is wider than the contact area corresponds to an area obtained when, supposing that, in the contact area, the length in a width direction of the intermediate transfer belt is $L_1$, and that the length in a moving direction of the intermediate transfer belt is $L_2$, the two ends in the width direction are respectively extended by a length $S_1$ corresponding to $L_1/100$ to $L_1/10$, independently, while the two ends in the moving direction are respectively extended by a length $S_2$ corresponding to $L_2/100$ to $L_2/10$, independently.

8. The image-forming apparatus of claim 1, wherein the toner supplied to the non-image area forms dots and the size of the dots is set in a range from 30 to 100 μm.

9. The image-forming apparatus of claim 1, wherein the toner supplied to the non-image area is a yellow toner.

10. The image-forming apparatus of claim 1, wherein the hard layer has 3 to 11 GPa in hardness.

11. An image-forming process comprising:

forming a latent image consisting of an image area and a non-image area on a latent-image supporting member, forming a toner image consisting of an image area and a non-image area on a latent-image supporting member by developing the latent image with a toner, transferring the toner image on the latent-image supporting member to an intermediate transfer belt having a hard layer on a surface thereof, and transferring the toner image on the intermediate transfer belt to an image-recording medium by contacting the toner image with the image-recording medium, wherein a toner is supplied to a non-image area in a contact area of the surface of the intermediate transfer belt with the image-recording medium at a range of 0.01 to 0.20 g/m$^2$.

12. The image-forming process of claim 11, wherein the hard layer of the intermediate transfer belt is a layer selected from the group consisting of an inorganic oxide layer, a hard carbon-containing layer and a cured resin layer.

13. The image-forming process of claim 11, wherein the hard layer of the intermediate transfer belt is an inorganic oxide layer containing at least one oxide selected from the group consisting of silicon oxide, aluminum oxide, zirconium oxide, titanium oxide and zinc oxide.

14. The image-forming process of claim 11, wherein the toner is supplied to a non-image area within the contact area of the surface of the intermediate transfer belt with the image-recording medium.

15. The image-forming process of claim 11, wherein the toner is supplied to a non-image area within an area including the contact area of the surface of the intermediate transfer belt with the image-recording medium and an area that is wider than the contact area.

16. The image-forming process of claim 15, wherein the area that is wider than the contact area corresponds to an area obtained when, supposing that, in the contact area, the length in a width direction of the intermediate transfer belt is $L_1$, and that the length in a moving direction of the intermediate transfer belt is $L_2$, the two ends in the width direction are respectively extended by a length $S_1$ corresponding to $L_1/100$ to $L_1/10$, independently, while the two ends in the moving direction are respectively extended by a length $S_2$ corresponding to $L_2/100$ to $L_2/10$, independently.

17. The image-forming process of claim 11, wherein the toner supplied to the non-image area forms dots and the size of the dots is set in a range from 30 to 100 μm.

18. The image-forming process of claim 11, wherein the toner supplied to the non-image area is a yellow toner.

19. The image-forming process of claim 11, wherein the hard layer has 3 to 11 GPa in hardness.

20. The image-forming apparatus of claim 1, wherein the non-image area is an area other than the area on which the toner image is formed.

21. The image-forming process of claim 11, wherein the non-image area is an area other than the area on which the toner image is formed.

* * * * *